US009056471B2

(12) United States Patent
Wijngaards et al.

(10) Patent No.: US 9,056,471 B2
(45) Date of Patent: Jun. 16, 2015

(54) METHOD OF FORMING A NOZZLE OF A FLUID EJECTION DEVICE

(71) Applicant: OCE TECHNOLOGIES B.V., Venlo (NL)

(72) Inventors: David D. L. Wijngaards, Tegelen (NL); Alex N. Westland, Baarlo (NL); Hendrikus J. M. Freriks, Venlo (NL); René J. Van Der Meer, Venlo (NL); Maikel A. J. Huygens, Venlo (NL); Hubertus M. J. M. Boesten, Venlo (NL)

(73) Assignee: OCE-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 14/039,587

(22) Filed: Sep. 27, 2013

(65) Prior Publication Data

US 2014/0021168 A1 Jan. 23, 2014

Related U.S. Application Data

(63) Continuation of application No. PCT/EP2012/056624, filed on Apr. 12, 2012.

(30) Foreign Application Priority Data

Apr. 13, 2011 (EP) ..... 11162182
Feb. 17, 2012 (EP) ..... 12155985

(51) Int. Cl.
*B41J 2/14* (2006.01)
*B44C 1/22* (2006.01)
*B41J 2/16* (2006.01)

(52) U.S. Cl.
CPC ..... *B41J 2/1629* (2013.01); *B41J 2/162* (2013.01)

(58) Field of Classification Search
USPC ..... 216/27, 41, 58, 83
See application file for complete search history.

(56) References Cited

U.S. PATENT DOCUMENTS

| | | | | |
|---|---|---|---|---|
| 6,563,079 | B1 | 5/2003 | Umetsu et al. | |
| 6,979,797 | B2 * | 12/2005 | Rivas et al. | 219/121.69 |
| 7,437,820 | B2 * | 10/2008 | Sexton et al. | 29/890.1 |
| 8,034,247 | B2 * | 10/2011 | Tsuboi et al. | 216/2 |
| 2009/0301998 | A1 * | 12/2009 | Uchiyama et al. | 216/27 |
| 2010/0134560 | A1 * | 6/2010 | Doi et al. | 347/47 |
| 2010/0165048 | A1 | 7/2010 | DeBrabander et al. | |

FOREIGN PATENT DOCUMENTS

| | | | |
|---|---|---|---|
| EP | 1 138 491 | A2 | 10/2001 |
| EP | 1 543 974 | A1 | 6/2005 |
| WO | WO 2009/147231 | A1 | 12/2009 |

* cited by examiner

*Primary Examiner* — Shamim Ahmed
(74) *Attorney, Agent, or Firm* — Birch, Stewart, Kolasch & Birch, LLP

(57) ABSTRACT

A method of forming a nozzle of a fluid ejection device, the nozzle having a straight mouth portion and a cavity portion, wherein the mouth portion is formed in a bottom surface of the substrate, and, after passivating the walls of the mouth portion, a wet etch process is applied from the bottom surface of the substrate for forming a part of the cavity portion with walls that diverge from the mouth portion, characterized in that a wet etch process is also applied from a top surface of the substrate for forming a part of the cavity portion which diverges towards the bottom surface and merges with the part that is etched from the bottom surface.

19 Claims, 10 Drawing Sheets

METHOD OF FORMING A NOZZLE OF A FLUID EJECTION DEVICE

The invention relates to a method of forming a nozzle of a fluid ejection device, the nozzle having a mouth portion and a cavity portion, wherein the mouth portion is formed in a bottom surface of a substrate, and, after passivating the walls of the mouth portion, a wet etch process (as used herein, a wet etch process is defined as an anisotropic etch along an crystallographic plane of a crystal substrate) is applied from the bottom surface of the substrate for forming a part of the cavity portion with walls that diverge from the mouth portion.

In a fluid ejection device, e.g. an ink jet device, a pressure wave is created which propagates in the ink in the cavity portion and is configured to generate such a pressure in the ink (or other liquid to be jetted from the fluid ejection device) towards the mouth portion, so that a droplet is ejected from the mouth portion.

In order for the droplet to be ejected in the correct direction, i.e. normal to the bottom surface of the substrate, it is important that the part of the cavity portion the walls of which converge towards the mouth portion is exactly aligned with the mouth portion.

WO 2009/147231 discloses a method, wherein the wet etch process proceeds along crystallographic planes of a single-crystal substrate, so that the cavity walls will diverge from the internal end of the mouth portion. This has the advantage that a self-alignment of the cavity portion with the mouth portion is achieved.

The etch process proceeds in both, the depth direction, i.e a direction substantially perpendicular to a surface of the substrate, and the width direction of the substrate, i.e. a direction substantially parallel to said surface of the substrate. For the sake of robustness, it is frequently desired that the substrate has a relatively large thickness. On the other hand, it is frequently required that the nozzles are arranged in the substrate with very small mutual distances, so that an ink jet printer with high resolution may be obtained. Consequently, the etch process should proceed rather fast in the depth direction but rather slow in the width direction to prevent that adjacent cavities, such as a nozzle and/or related passages and cavities, merge into a single cavity.

US 2010/165048 A1 discloses a method wherein, in a first step, a part of the cavity is formed by wet etching from the side of the mouth portion, and, in a second step, another etch process is applied from the opposite side so as to form a straight large-diameter part of the cavity that will merge with the part that diverges from the mouth portion. In this method, the substrate in which the nozzle is formed serves only as a nozzle plate which is then bonded to another device body which forms a larger part of an ink cavity that is aligned with and communicates with the cavity portion of the nozzle.

EP 1 138 491 discloses a method, wherein a mask which has only a small-diameter opening is formed on the bottom side of the substrate and a mask having a larger opening is formed on the opposite side, and then a wet etch process is applied from both sides of the substrate. When the masks are stripped off, one obtains a nozzle in which the converging walls of the cavity portion extend down to the bottom surface of the substrate where they form a converging nozzle orifice. Thus, the nozzle does not have a mouth portion having a well-defined form. However, a well-defined mouth portion is desirable for assuring a stable and reproducible droplet generation.

It is noted that herein reference may be made to a "straight mouth portion". Such straight mouth portion is intended to mean a tubular portion extending from the cavity portion to a mouth (commonly and herein also referred to as nozzle). Such tubular portion may be regarded substantially straight, even if the particular tubular portion exhibits features deviating from straightness. For example, a slightly conically shaped mouth portion or a sandglass shaped mouth portion are intended to be included in the term "straight mouth portion". In general, the (straight) mouth portion is a well-defined portion extending from the cavity portion to the nozzle and having a relatively small cross-sectional area compared to the cavity portion, i.e. the (straight) mouth portion forms a bottleneck-like structure.

It is an object of the invention to provide a method of forming a nozzle with improved controllability of the etch process for forming the cavity portion.

According to the invention, this object is achieved by a method of the type indicated in the opening paragraph, in which a wet etch process is also applied from a top surface of the substrate for forming a part of the cavity portion which diverges towards the bottom surface and merges with the part that is etched from the bottom surface.

Since the wet etch process proceeds from both, the top surface and the bottom surface of the substrate, the cavity portion of the nozzle is created in a configuration having a diverging top part and a converging bottom part, as seen in the top-down direction. The wet etch process proceeding from the mouth portion of the nozzle assures a perfect alignment between this mouth portion and the bottom part of the cavity portion. In the region where the diverging top part and the converging bottom part of the cavity portion are joined to one another, the cavity portion will have its largest width dimension and its largest cross-section. This has the advantage that any possible misalignment between the top part of the cavity portion (i.e. the part of the cavity portion away from the mouth portion) on the one hand and the mouth portion on the other hand is compensated for automatically, since the bottom part of the cavity portion (i.e. the part of the cavity portion near the mouth portion) and the mouth portion are inherently aligned by the method. Taking into account the relatively large width dimension of the cavity portion compared to the cross-sectional area of the mouth portion, any remaining misalignment will as a result not have any significant adverse effect on the droplet generation.

Moreover, since the wet etch process may proceed from two sides of the substrate simultaneously, the etching time may be reduced significantly, which permits not only an increased productivity but has also the advantage that an underetching at the transition between the internal end of the passivated wall of the mouth portion and the bottom part of the cavity portion may be avoided or limited, so that substantially no step or plateau will occur at this transition and the slanting walls of the cavity portion are smoothly adjoined to the walls of the mouth portion. This avoids possible disturbances in the fluid flow that might destabilize the drop generation process. Additionally, if multiple mouth portions and associated cavity portions are being formed, the length of each mouth portion will be substantially the same as the length of the other mouth portions, thus obtaining a reduced length variation and consequently similar jetting conditions for each mouth portion.

The invention has the further advantage that the growth of the cavity portion in the width direction may be controlled and limited, even in a relatively thick substrate. This permits the production of a robust device with a high nozzle density.

Preferred embodiments of the invention are indicated in the dependent claims.

By etching the mouth portion of the nozzle into the bottom surface of the substrate and then passivating the walls of the mouth portion, the length of this mouth portion may be controlled with high precision, so that the drop ejection properties may be uniform over all the nozzles of the device. In a subsequent etching step, the channel that forms the mouth portion of the nozzle may be extended into the substrate, so that the time required for the subsequent wet etching step may be reduced further. By appropriately selecting the depth of the extended channel, the etching time may be controlled precisely. It is noted that during such extension processing, the passivation of the walls of the mouth portion is maintained.

Similarly, a straight channel may first be formed in the top surface of the substrate, the walls of this channel may be passivated, and then the wet etching process may be started to proceed from the internal end of this channel. In this case, the depth of the straight channel formed in the top surface of the substrate provides another means for controlling the overall etching time and also the shape of the cavity portion.

In a particular embodiment of the above-described method for providing a nozzle of a fluid ejection device, wherein the nozzle comprises a mouth portion and a cavity portion and wherein such nozzle extends through a substrate, the walls of the mouth portion are provided as a trench and these walls (trench) are passivated as shown in FIG. 3 (elucidated hereinafter). Then, as described hereinafter, the mouth portion is formed by a suitable etch process, resulting in the assembly shown in FIG. 4 (described hereinafter). The present particular embodiment of the present invention provides a method to perform such etch process accurately. However, the additional method steps of the present particular embodiment is not limited to use in such nozzle manufacturing process, but may also be used for any other etch process requiring a high accuracy. The additional method steps comprised in the above-indicated particular embodiment comprise the steps (a) forming a trench in a surface of the substrate, which trench is positioned at a desired position of a wall of the mouth portion;
(b) filling the trench with an etch resistant material;
(c) applying an etch resistant mask layer on the surface of the substrate;
(d) providing a mask opening in the etch resistant mask layer such that an edge of the mask opening is position on the etch resistant material arranged in the trench; and
(e) performing a dry etch of the substrate through the mask opening such that the resulting mouth portion is positioned by the etch resistant material arranged in the trench.

As shown in FIG. 3, passivating the walls of the trench may result in the (bottom) surface of the substrate being passivated. It may be difficult to open the—thus provided—mask layer only in the area surrounded by the trench. The present particular embodiment is based on the insight that a width of the trench may be employed to overcome such difficulty. A further mask layer may be provided over the mask layer and the further mask layer is provided with a mask opening. The mask opening may be larger than the area surrounded by the trench, but an edge of the mask opening should be arranged over the trench. Then, possibly preceded by other steps, a dry etch process is performed using the etch resistant material arranged in the trench as a mask. Thus, the mouth portion or a resulting recess, also herein referred to as an extension, is centred around a centre of the trench.

Note that the method steps of this particular embodiment may be employed for any recess that needs to be accurately aligned and hence the use of these method steps is not limited to providing a mouth portion or an extension as described herein.

For forming a nozzle of an inkjet print head, the method according to the present invention is continued by a wet etch process for forming a diverging cavity portion which is also centred around a centre of the trench. Then, the mask layer is removed, including the etch resistant material arranged in the trench, after which, in case a silicon substrate is used, a final oxidation step for protecting the silicon substrate may be performed.

Preferred embodiments of the invention will now be explained in conjunction with the drawings, wherein.

FIGS. 14-26 schematically illustrate a method for forming a nozzle in a substrate suitable for use in an embodiment of the present invention.

Figure 1:
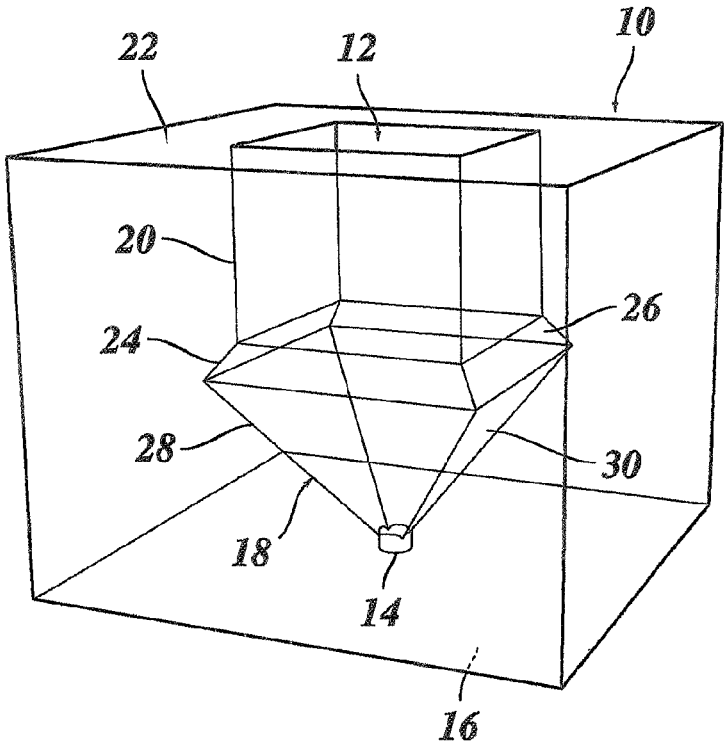
FIG. 1 is a perspective view of a nozzle structure formed by means of the method according to the invention.

FIG. 1 shows a parallelepipedal portion of a substrate 10, e.g. a portion of a single-crystal Si wafer, in which a nozzle 12 has been formed. The portion of the substrate 10 shown in FIG. 1 forms part of a larger monolithic fluid ejection device, e.g. an ink jet printhead, in which a one- or two-dimensional array of nozzles 12 has been formed.

The nozzle 12 has a cylindrical mouth portion 14 which opens out into a bottom surface 16 of the substrate 10, and a cavity portion 18 via which the fluid (ink) is supplied to the mouth portion 14. The cavity portion 18 comprises a top part 20 in the form of a straight channel that extends from a top surface 22 of the substrate 10 into the interior of the substrate, a central part 24 delimited by walls 26 that diverge from a bottom end of the top part 20, and a bottom part 28 delimited by walls 30 that converge towards the mouth portion 14. In the example shown, the cavity portion 18 has a square cross-section, so that the central part 24 is shaped as a truncated pyramid and the bottom part 28 is shaped as an inverted pyramid the tip of which merges into the cylindrical mouth portion 14.

The block of the substrate 10 that has been shown in FIG. 1 may form part of a nozzle plate that is bonded to another component member (not shown) of an ink jet printhead, said other component member defining an ink chamber and/or a feedthrough that communicates with the top part 20 of the cavity portion 18. In this case, said other component member may form or carry an actuator for generating a pressure wave in the ink chamber. This pressure wave will propagate through the feedthrough into the cavity portion 18 of the nozzle 12. Due to the acoustics of the ink chamber and the feedthrough and the slanting walls 30 of the bottom part 28 of the cavity portion, this pressure wave results in an ink droplet being ejected from the mouth portion 14. In order for the ink droplet to be ejected exactly in the direction normal to the bottom surface 16 of the substrate, it is important that the pyramid shaped bottom part 28 of the cavity portion 18 is perfectly aligned with the central axis of the cylindrical mouth portion 14.

In another embodiment, the abovementioned ink chamber and/or feedthrough and other components of the device and the nozzle 12 may be formed integrally in a single wafer. In this case, the top surface 22 shown in FIG. 1 would not form the top surface of the wafer but would for example form a bottom of the ink chamber (not shown).

It will be understood that the terms "top" and "bottom" as used herein are not intended to limit the scope of the invention but are just used for the purpose of clarity. Thus, the bottom surface 16 is defined as the surface of the substrate in which the mouth portion 14 of the nozzle is formed and the top surface is the surface of the substrate opposite to the bottom surface 16.

A method of forming the nozzle 12 with the configuration shown in FIG. 1 will now be explained in conjunction with FIGS. 2 to 9.

Figure 2:
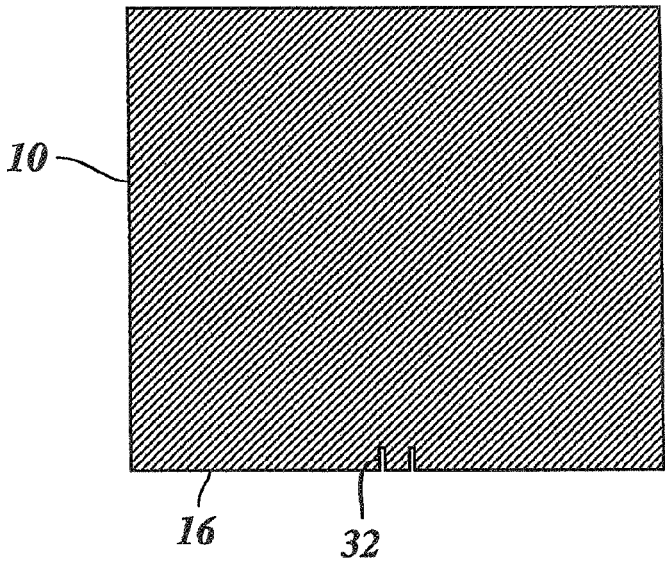
FIGS. 2-9 are cross-sectional views of a portion of a substrate, illustrating essential steps of a first embodiment of the method according to the invention.

As is shown in FIG. 2, an annular trench 32 is formed in the bottom surface 16 of the substrate 10, using conventional photolithographic masking techniques and directional etching techniques such as DRIE (Deep Reactive Ion Etching). The depth of the trench 32 may be controlled by precisely controlling the etching parameters, especially the etching time. In practice, also a shape other than annular may be employed, in particular, the shape of the trench 32 should correspond with a desired shape of a nozzle.

Figure 3:
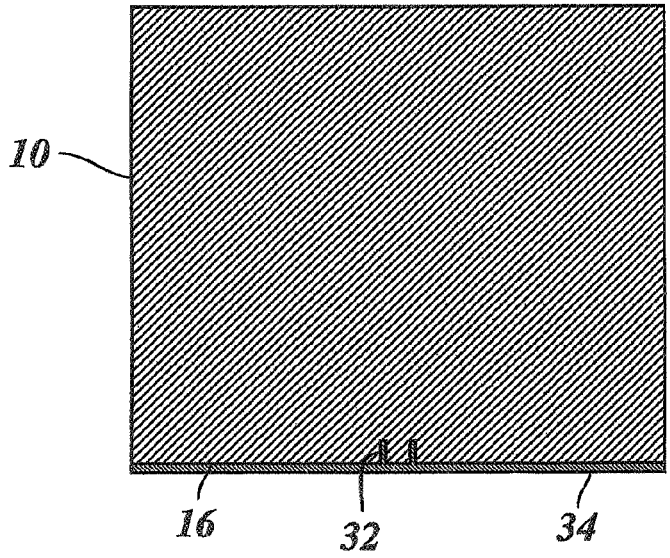

Then, as is shown in FIG. 3, the walls of the trench 32 are passivated by applying an etch mask/passivation layer 34, e.g. $SiO_2$ or $Si_3N_4$ to the internal walls of the trench and to the bottom surface 16 of the substrate. In the example shown, the etch mask layer 34 fills the entire trench 32, although it may suffice to ensure that the walls of the trench are sufficiently covered by the etch mask/passivation layer 34.

Figure 4:
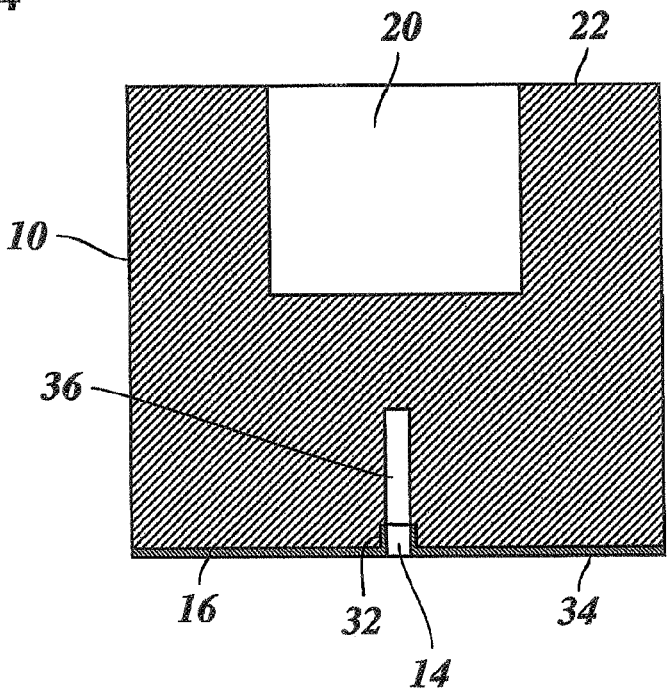

As is shown in FIG. 4, an anisotropic dry etch process, e.g. RIE or DRIE, is applied for removing the part of the substrate 10 that is surrounded by the trench 32, thereby to form the mouth portion 14 of the nozzle. The dry etch process is continued at least until the depth of the channel that is etched into the substrate 10 corresponds to the depth of the trench 32. In the example shown, the dry etch process is continued further, so that a cylindrical extension 36 of the mouth portion 14 is formed in the substrate 10.

Another dry etch process is applied from the top surface 22 of the substrate 10 in order to form the top part 20 of the cavity portion of the nozzle. This step may be performed before or after the step of forming the mouth portion 14 and the extension 36 or simultaneously therewith.

Figure 5:
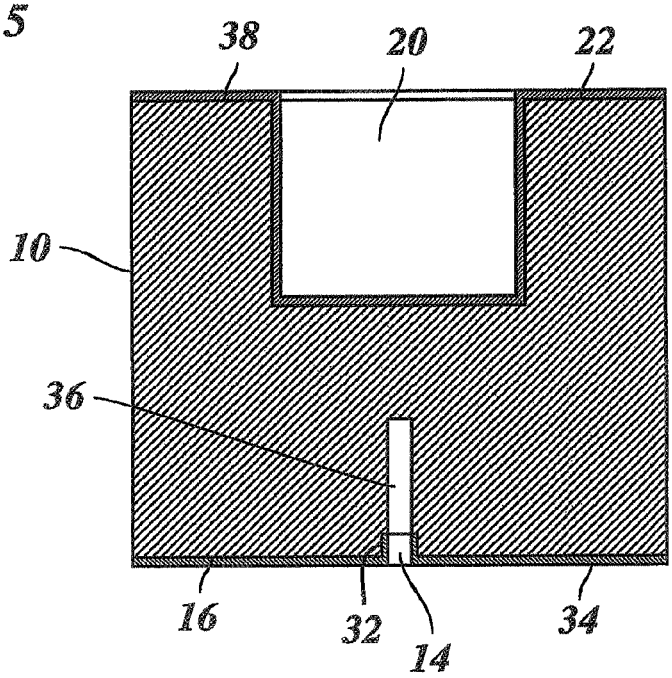

Then, as is shown in FIG. 5, the walls of the top part 20 are passivated by applying another etch mask layer 38, e.g. $SiO_2$ or $Si_3N_4$.

Figure 6:
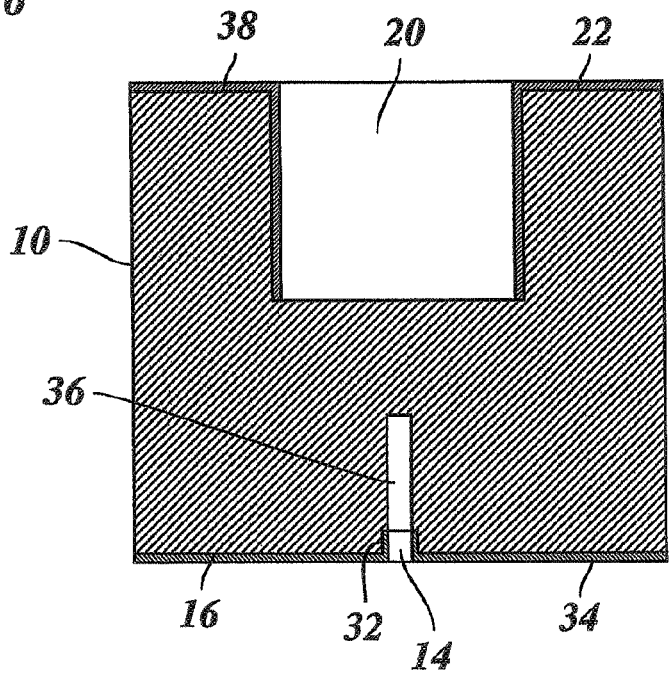

As is further illustrated in FIG. 6, the part of the etch mask layer 38 that covers the bottom of the top part 20 is removed in another RIE or DRIE etch process. In an optional subsequent step that has been illustrated in FIG. 7, the etch process is continued so as to increase the depth of the top part 20 beyond the lower ends of the passivation layers 38 on the side walls.

Figure 8:
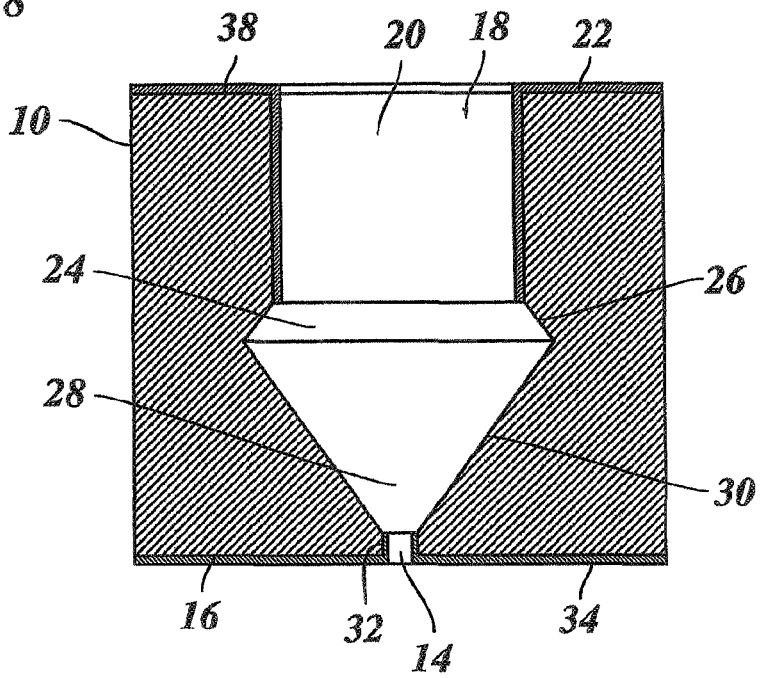

Then, the entire substrate 10 is immersed into a wet etching solution such as KOH or TMAH (tetramethyl ammonium hydroxide), so that the central part 24 and the bottom part 28 of the cavity portion of the nozzle are etched simultaneously from opposite sides of the substrate, as has been shown in FIG. 8.

In this example, the substrate 10 is formed by a <100> wafer (i.e. a wafer of a crystal material with a crystal orientation <100>). The etch rate of the wet etch process is slowest in the crystallographic <111> directions. As a consequence, the walls 26 of the central part 24 of the cavity portion are formed by <111> planes that diverge from the lower ends of the etch mask layer 38 on the side walls of the top part 20, and the walls 30 of the bottom part 28 are formed by <111> planes that diverge from the innermost end of the passivation layer 34 that had filled the trench 32.

Since the substrate material in the areas adjacent to the lower end of the etch mask layer 38 and to the top of the etch mask layer 34 is protected by these etch mask layers, the walls 26 of the central part 34 will smoothly adjoin the internal walls of the top part 20, and, similarly, the walls 30 of the bottom part 28 will smoothly adjoin the peripheral wall of the mouth portion 14. The etch process is continued until the cavities that grow upwardly from the mouth portion 14 and downwardly from the top part 20 merge at the border between the central part 24 and the bottom part 28.

Figure 9:
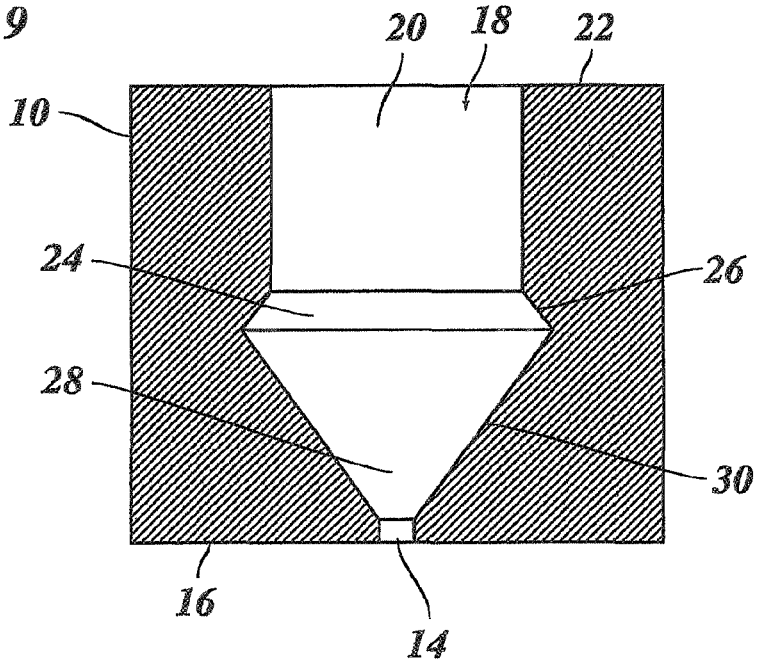

When the wet etch process would be continued for a longer period of time, the substrate material would also be etched away in the slow direction normal to the <111> planes, resulting in a certain amount of so-called underetching at the lower ends of the etch mask layer 38 and the top end of the etch mask layer 34. However, by appropriately adjusting the depth of the top part 20 (in the step shown in FIG. 6 or 7) and by adjusting the depth of the extension 36, the time required for the wet etching process may be controlled such that an excessive underetching is prevented. Preferably, the process is controlled such that the amount of underetching just corresponds to the thickness of the etch mask layers 38 and 34. Consequently, when these etch mask layers are stripped off in a final step, the final shape of the nozzle 12 will correspond to what is shown in FIG. 9, i.e. the walls 30 of the bottom part 28 adjoin the peripheral wall of the mouth portion 14 without forming a substantial shoulder or discontinuity.

This reduces the amount of disturbances in the flow of a fluid towards the mouth portion 14, so that stable and reproducible droplet generation is achieved. Moreover, since the pyramid shaped bottom part 28 of the cavity portion is perfectly aligned with the mouth portion 14, the droplets will be ejected in the direction exactly normal to the bottom surface 16.

Further, since the length of the mouth portion 14 is defined by the depth of the trench 32, all mouth portions of all the nozzles formed in the substrate will have the same depth, so that the drop ejection characteristics are uniform for all the nozzles. In an embodiment, a silicon-oxide layer may be provided, wherein the silicon-oxide layer has a thickness equal to a desired mouth portion length. In such embodiment, etching of the trench may be performed such that the etching stops at the interface of the silicon-oxide layer and the silicon of the substrate. Thus, a well-defined length of the mouth portion is obtained as the length corresponds to the thickness of the silicon-oxide layer and the duration of the etching step is less critical and relatively simple and consequently advantageous.

While the bottom part 28 of the cavity portion will be aligned with the mouth portion 14, the central part 24 will be aligned with the top part 20. Thus, in case that a slight misalignment has occurred in the steps of masking the top and bottom surfaces 22, 16 of the substrate for forming the trench 32 and the top part 20 of the cavity portion, such misalignment would only result in minor distortions of the shape of the cavity portion at the transition between the central part 24 and the bottom part 28, i.e. in the region where the cross-section of the cavity portion is largest. In this region, any deviations from the ideal shape of the cavity portion will have the smallest influence on the fluid flow and the drop ejection properties.

Although an SOI wafer might be used as the substrate 10, with an insulator layer defining the depth of the mouth portion 14, it is an advantage of the embodiment that has been described here that a relatively cheap single-crystal Si wafer may be used for the substrate 10, since the depth of the mouth portion 14 can be controlled with sufficient accuracy by controlling the process in which the trench 32 is etched.

Figure 10:
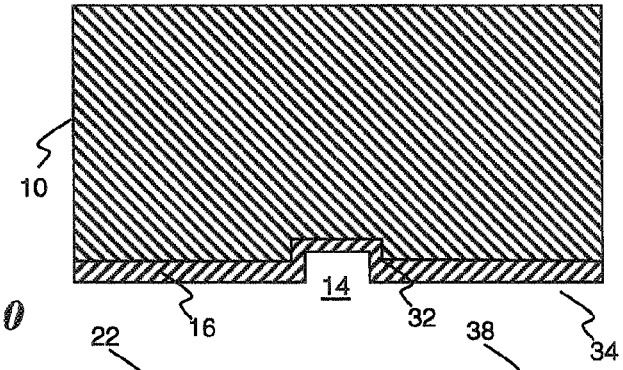
FIGS. 10-13 are cross-sectional views of a portion of a substrate, illustrating essential steps of a second embodiment of the method according to the invention.

FIGS. 10-13 illustrate a second embodiment of the method according to the present invention, using the same reference numerals as used in FIGS. 2-9. Referring to FIG. 10, a substrate 10 is provided with a mouth portion 14 and a passivating layer 34 being arranged on the bottom surface 16, e.g. provided using a trench 32 as illustrated in and described in relation to FIGS. 2-4, but other suitable methods may have been employed as well. For example, first a mouth portion 14 may have been etched by a DRIE process and thereafter a wall of the mouth portion 14 may have been passivated.

Figure 11:
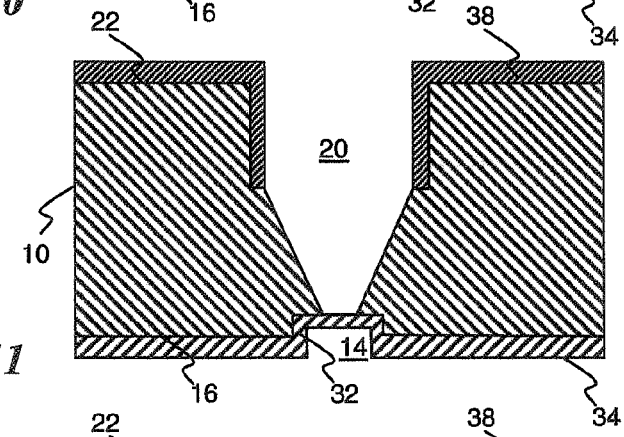

Having provided the mouth portion 14 and having passivated all walls thereof, the top part 20 is suitably etched using suitable passivation layers such as passivating layer 38 in the top surface 22 of the substrate 10. Further, a first wet etch process is performed from the top part 20 towards the mouth portion 14 until the etch reaches the passivated top wall of the mouth portion 14, as illustrated in FIG. 11. Due to the crystal structure of the substrate 10, a triangular shaped cavity is provided between the top wall of the mouth portion 14 and the top part 20. As illustrated, the dimensions of the top part 20, the dimensions of the mouth portion 14 and a distance between the top part 20 and the mouth portion 14 before wet etching are preferably selected such that after wet etching a diameter of the triangularly shaped cavity at the top wall of the mouth portion 14 is smaller than a diameter of the mouth portion 14.

Figure 12:
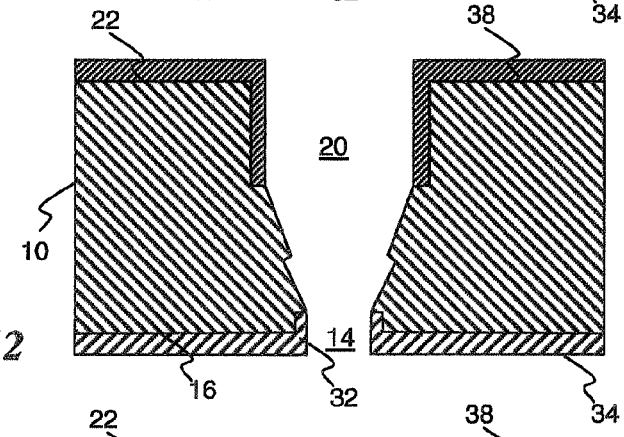
Figure 13:
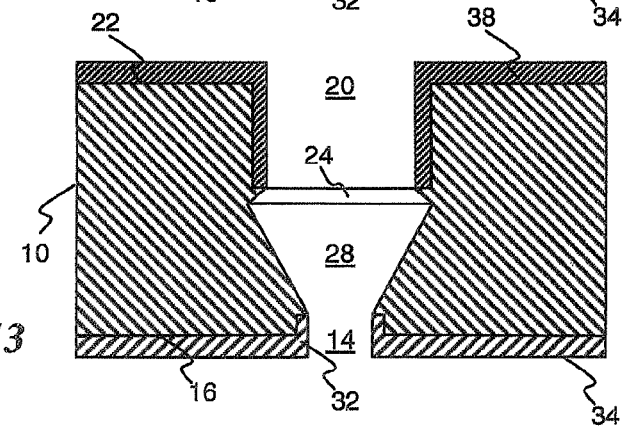

Referring to FIGS. 12 and 13, removing the top wall of the mouth portion 14 and performing a second wet etch from the mouth portion 14 towards the top part 20 results in the cavity portion comprising the central part 24 and the bottom part 28.

In this second embodiment, a sufficient flow of the etch fluid is inherent during the first wet etch processing step due to the relatively large opening of the cavity being etched, while in the first embodiment it may be required to force a suitable flow of etch fluid. Further, in the second embodiment, most substrate material has been removed by the first wet etch processing step and consequently the mouth portion 14 will only be subjected to the wet etch for a relatively short period, which may prevent an underetching and thus may provide a well-defined length of the mouth portion 14.

FIGS. 14-26 show a particular embodiment of a method for manufacturing a nozzle aligned with a cavity substantially in accordance with the method as illustrated in FIGS. 2-9. Hereinafter, the particular embodiment is described in more detail, while any method steps similar to the method steps described in relation to FIGS. 2-9 may be elucidated by reference to the description relating to FIGS. 2-9.

Figure 14:
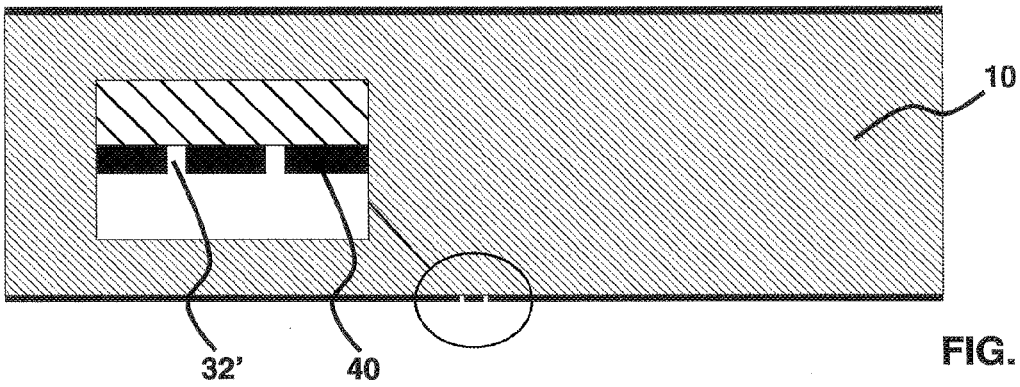
Figure 15:
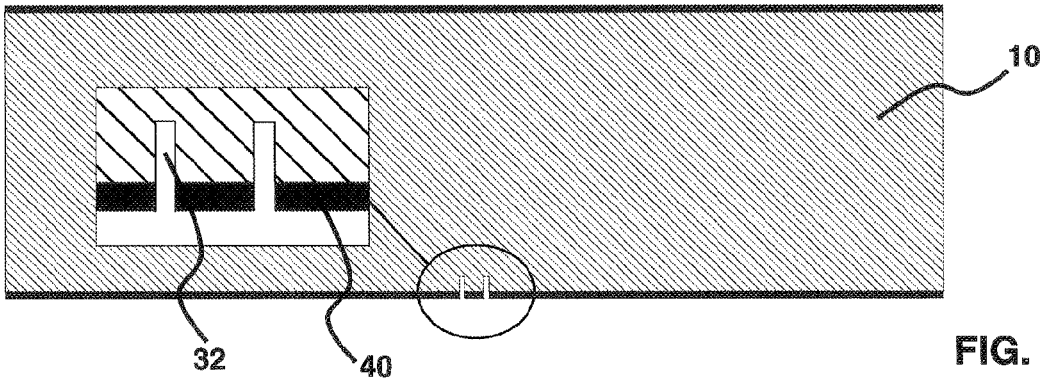

FIGS. 14 and 15 illustrate method steps for forming a trench 32 (see also FIG. 2) in the substrate 10, which trench 32 defines the walls of the nozzle mouth portion 14. In particular, FIG. 14 illustrates an etch resistant mask 40 having arranged therein an opening 32' at a position and having a shape corresponding to a desired position and shape of the nozzle mouth portion 14. In more detail, the position of the walls defines a position of a centre line (extending in the direction in which the nozzle mouth portion 14 extends) of the nozzle mouth portion 14. For good ejection properties, a centre line of the diverging portion of the cavity portion (i.e. bottom part 28, see FIG. 8-9, for example) should coincide with a centre line of the nozzle mouth portion 14.

FIG. 15 illustrates the trench 32 resulting after suitable etch processing, which is well known in the art.

Figure 16:
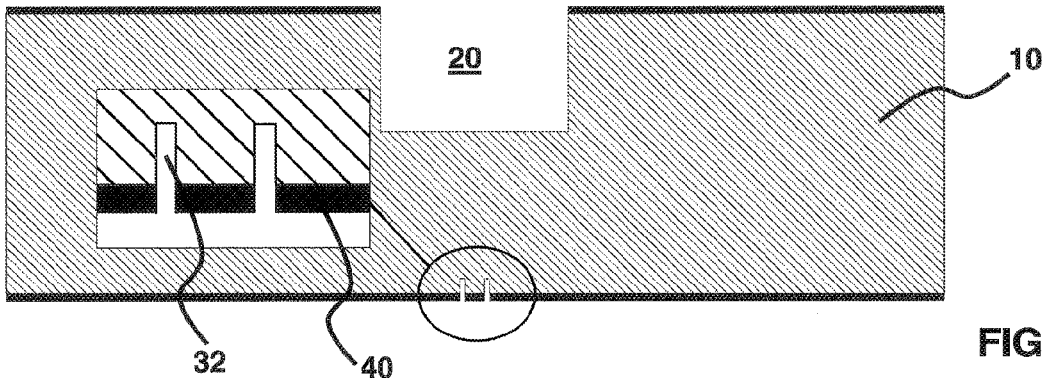

FIG. 16 illustrates the top part 20 provided in the substrate 10 (cf. FIG. 4 and the related description). The top part 20 is for example provided by applying a suitable mask, etching the top part 20 and removing the mask. A suitable process for providing the top part 20 is well known in the art.

Figure 17:
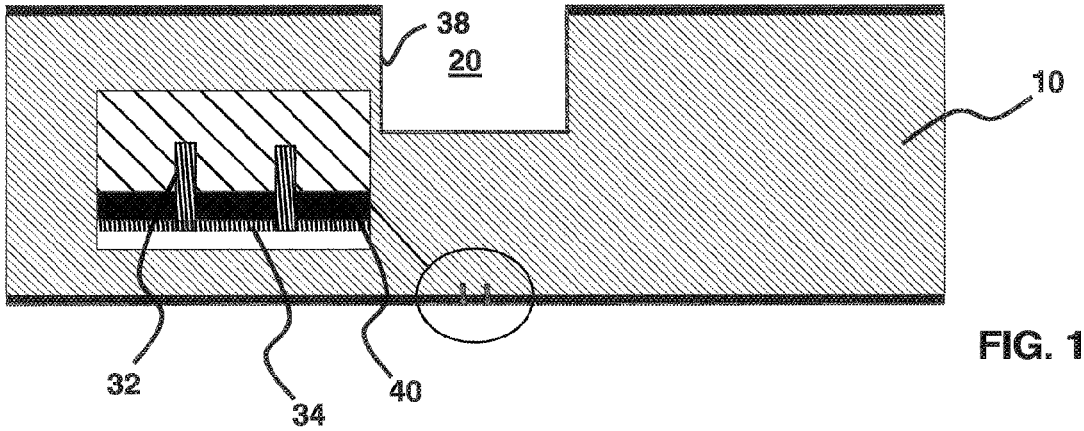

FIG. 17 shows the trench 32 filled with an etch resistant material 32 such as a thermally grown $SiO_2$ or any other suitable material. The etch resistant material is also provided on the bottom surface of the substrate 10, which is however not essential for the present invention. An etch resistant material forms an etch resistant layer 38 in the top part 20.

Figure 18:
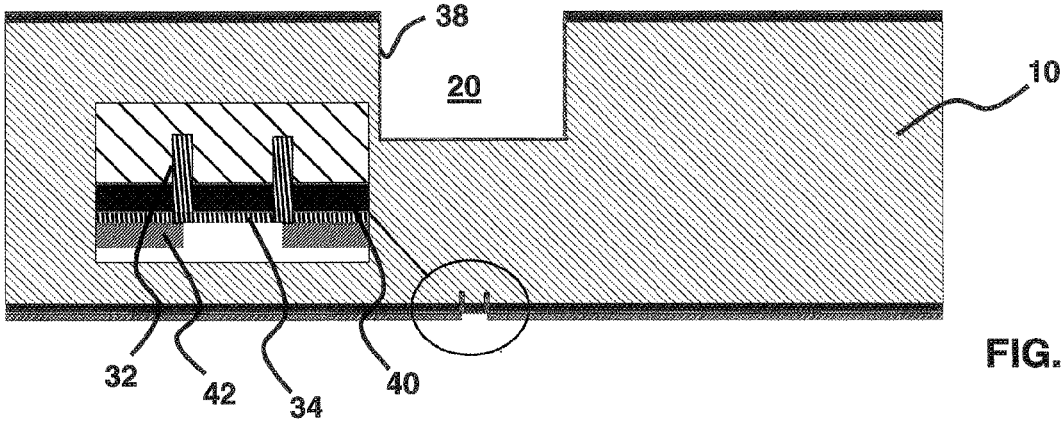

FIG. 18 shows a further mask layer 42 being provided over the etch resistant material 34. A mask opening is provided, wherein an edge of the mask opening is positioned over the etch resistant material 34 in the trench 32.

Figure 19:
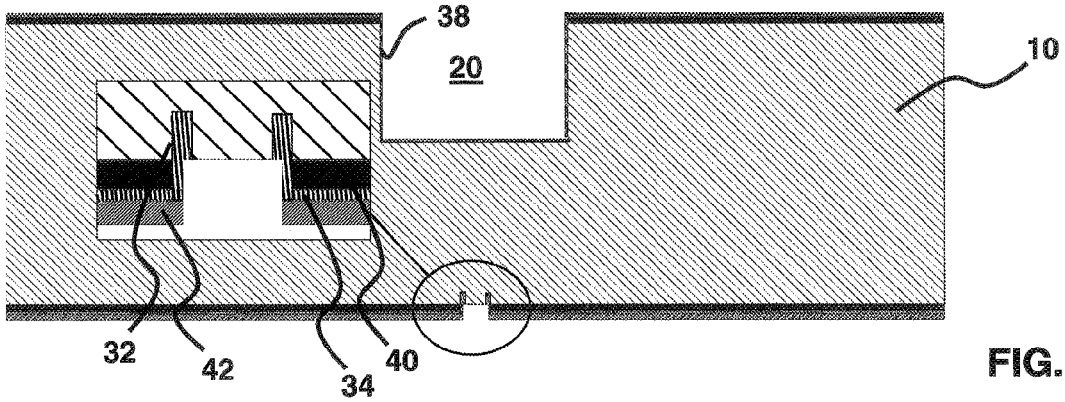

FIG. 19 shows that the etch resistant material 34 is partly removed by a suitable etch process using the further mask layer 42 as a mask. By this process step, the material of the substrate 10 enclosed/surrounded by the trench 32 is exposed. The etch resistant material 34 in the trench 32 may also be (partly) exposed. No material of the substrate 10 outside the trench 32 should be exposed.

Figure 20:
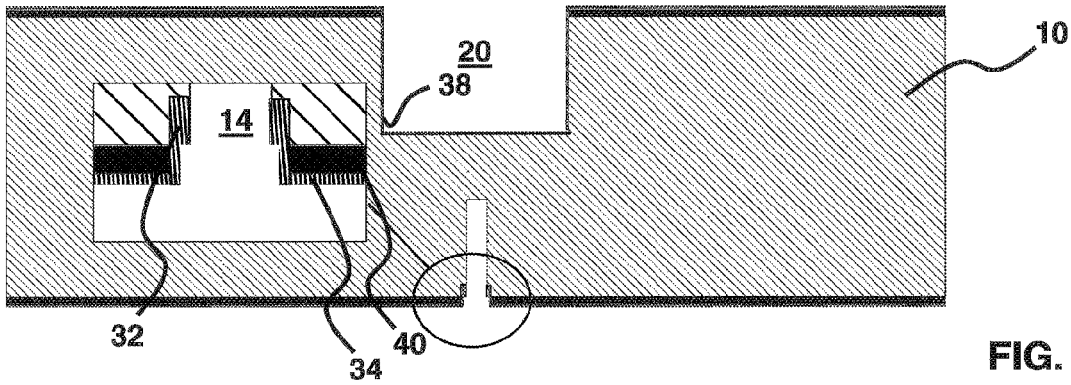

FIG. 20 shows that, using the etch resistant material 34 in the trench 32 as a mask, the nozzle mouth portion 14 and an extension 36 is etched in the substrate 10. Note that the nozzle mouth portion 14 corresponds to the volume enclosed by the trench 32.

Figure 21:
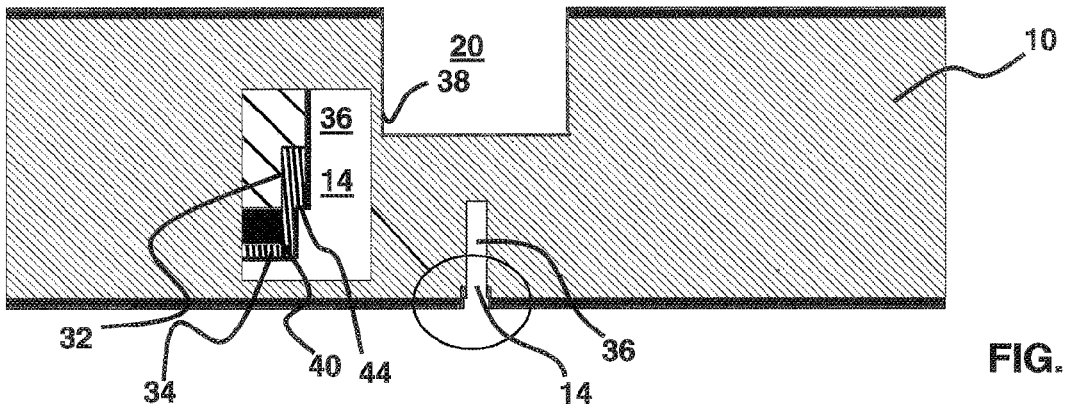

FIGS. 21-25 show method steps for suitably forming the cavity corresponding to the method as shown in and described in relation to FIG. 2-9. In FIG. 21, it is shown that a etch resistant material layer 44 is provided in the extension 36 and the nozzle mouth portion 14. For example a thermally grown $SiO_2$ may be employed, but any other suitable material may be used as well.

Figure 7:
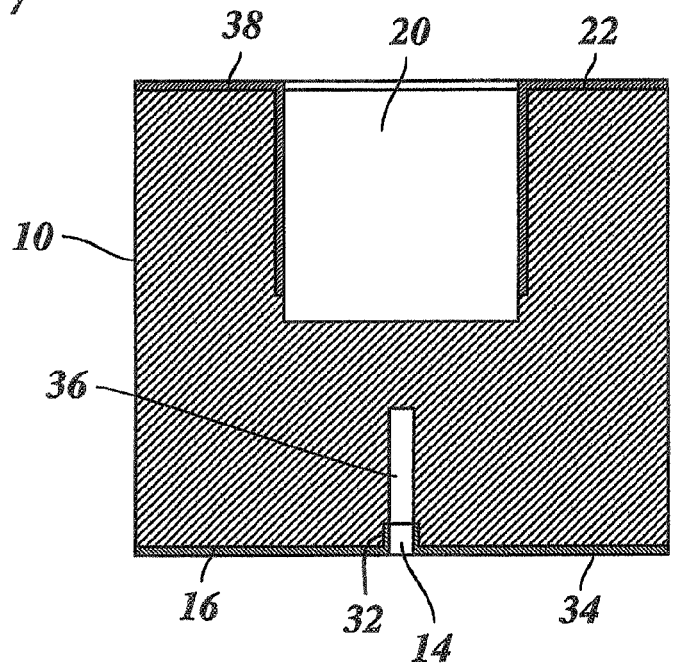
Figure 22:
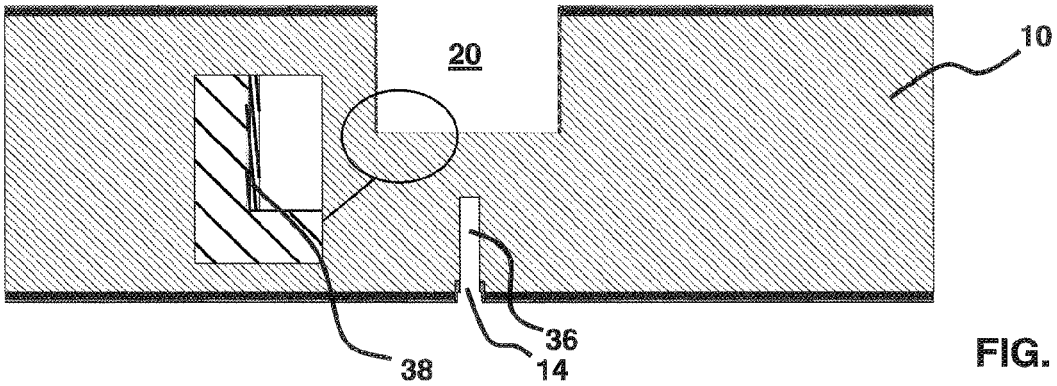

In FIG. 22 the etch resistant layer 38 is removed from a bottom surface of the top part 20 using any suitable method such as well known in the art (cf. FIG. 7 and the related description).

Figure 23:
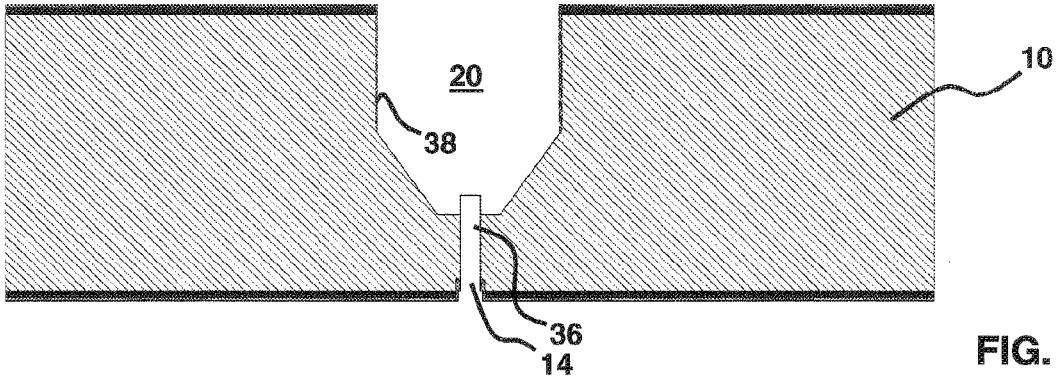
Figure 24:
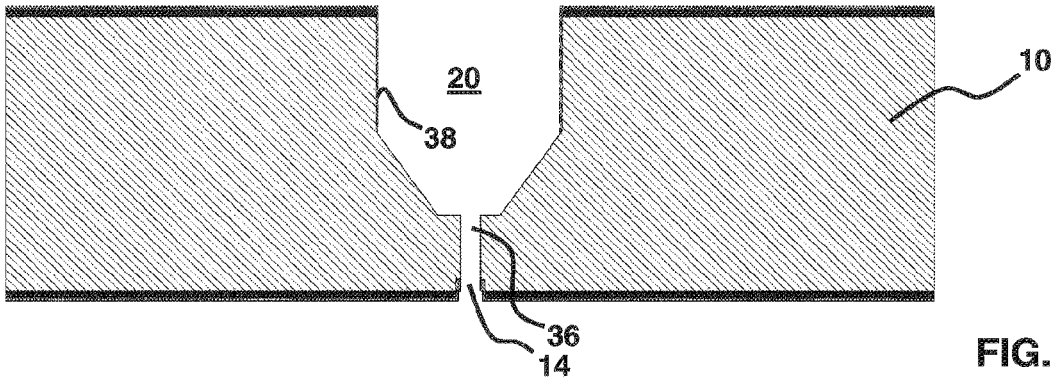

Using a suitable etching process, etching is performed from the bottom surface of the top part 20 towards the extension 36. As illustrated in FIG. 23, the etch resistant material layer 44 remains, thereby extending into the top part 20. As shown in FIG. 24, the etch resistant material layer 44 is then removed from the walls of the extension 36, including the part of the etch resistant material layer 44 extending into the top part 20.

Figure 25:
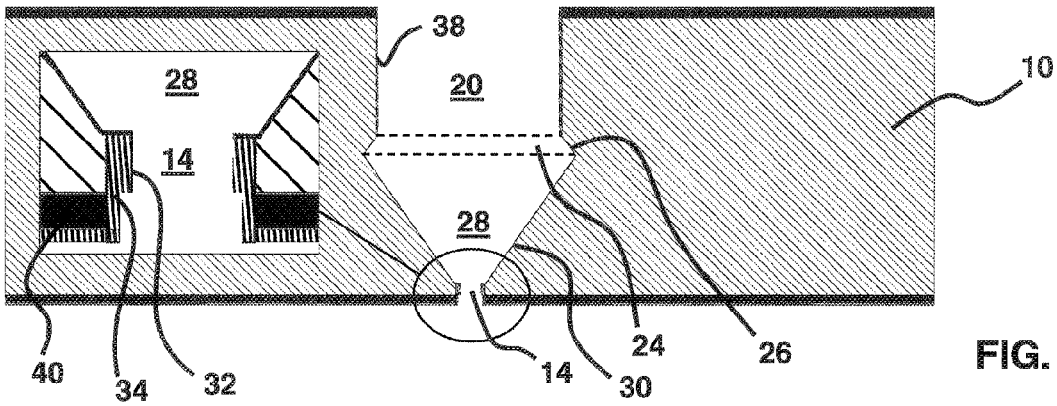

In FIG. 25, as described hereinabove in relation to FIGS. 8-9, a suitable etch processing is used to provided a cavity comprising the central part 24 and the bottom part 28 having walls 26 and 30, respectively. Further, it is shown that some underetching may occur with respect to the etch resistant material 34 in the trench 32. Since this underetching is symmetrical relative to the centre line of the mouth portion 14, the underetching does not provide any functional problems of the resulting inkjet device.

Figure 26:
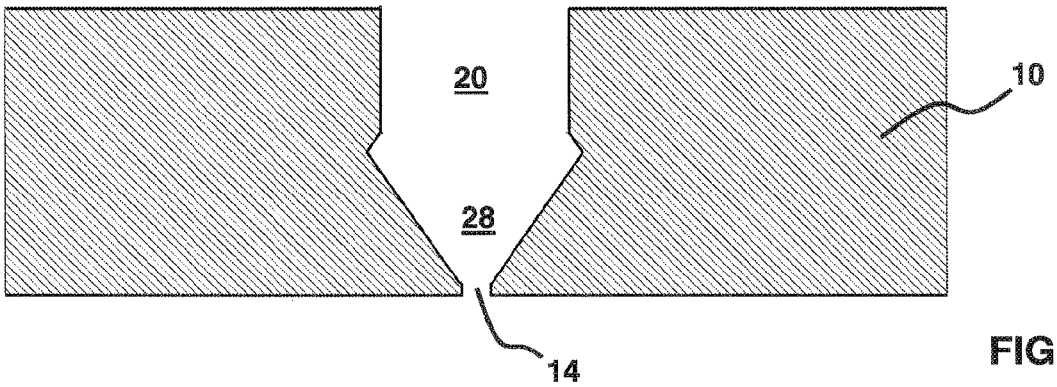

FIG. 26 shows that the etch resistant material 34, etch resistant mask 40, and etch resistant layer 38 are removed, resulting in an accurately arranged nozzle having an accurately aligned mouth portion 14 and diverging portion 28 of the cavity portion.

As described, disclosed and elucidated herein, a variation in droplet ejection angle and speed between separate nozzles of an inkjet print head is significantly reduced when using the method according to the present invention for manufacturing the nozzles of the print head. Further, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. In particular, features presented and described in separate dependent claims may be applied in combination and any advantageous combination of such claims are herewith disclosed.

Further, the terms and phrases used herein are not intended to be limiting; but rather, to provide an understandable description of the invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A method of forming a nozzle of a fluid ejection device, the nozzle having a straight mouth portion and a cavity portion, wherein the mouth portion is formed in a bottom surface of a substrate, and, after passivating walls of the mouth portion, a wet etch process is applied from the bottom surface of the substrate for forming a part of the cavity portion with walls that diverge from the mouth portion, wherein a wet etch process is also applied from a top surface of the substrate for forming a part of the cavity portion which diverges towards the bottom surface and wherein the part that is etched from the bottom surface and the part that is etched from the top surface merge.

2. The method according to claim 1, wherein the substrate is immersed in an etching solution for performing the wet etch process from the top side and the bottom side of the substrate simultaneously.

3. The method according to claim 1, comprising the steps of:

forming a top part of the cavity portion in the form of a straight channel that extends from a top surface of the substrate, passivating the walls of the top part with an etch mask layer, removing the part of the etch mask layer that covers the bottom end face of the channel, and applying the wet etch process from the top surface of the substrate.

4. The method according to claim 1, wherein, when the walls of the mouth portion have been passivated, an etch process is applied for forming an extension of the mouth portion that penetrates deeper into the substrate, thereby to control the time required for the later wet etch process.

5. The method according to claim 3, wherein the depth of the channel forming the top part of the cavity portion and the depth of the extension of the mouth portion are controlled such that the extension remains separated from the top part.

6. The method according to claim 1, wherein the mouth portion is formed by etching a trench into the bottom surface of the substrate, passivating the internal walls of the trench with an etch mask layer, and removing the material of the substrate that is surrounded by the trench.

7. The method according to claim 1, the method comprising (a) forming a trench in a surface of the substrate, which trench is positioned at a desired position of a wall of the mouth portion;

(b) filling the trench with an etch resistant material, thereby passivating the internal walls of the trench with an etch mask layer;

(c) applying an etch resistant mask layer on the surface of the substrate;

(d) providing a mask opening in the etch resistant mask layer such that an edge of the mask opening is positioned on the etch resistant material arranged in the trench;

(e) performing a dry etch of the substrate through the mask opening such that the resulting mouth portion is positioned by the etch resistant material arranged in the trench.

8. The method according to claim 2, comprising the steps of:

forming a top part of the cavity portion in the form of a straight channel that extends from a top surface of the substrate, passivating the walls of the top part with an etch mask layer, removing the part of the etch mask layer that covers the bottom end face of the channel, and applying the wet etch process from the top surface of the substrate.

9. The method according to claim 2, wherein, when the walls of the mouth portion have been passivated, an etch process is applied for forming an extension of the mouth portion that penetrates deeper into the substrate, thereby to control the time required for the later wet etch process.

10. The method according to claim 3, wherein, when the walls of the mouth portion have been passivated, an etch process is applied for forming an extension of the mouth portion that penetrates deeper into the substrate, thereby to control the time required for the later wet etch process.

11. The method according to claim 4, wherein the depth of the channel forming the top part of the cavity portion and the depth of the extension of the mouth portion are controlled such that the extension remains separated from the top part.

12. The method according to claim 2, wherein the mouth portion is formed by etching a trench into the bottom surface of the substrate, passivating the internal walls of the trench with an etch mask layer, and removing the material of the substrate that is surrounded by the trench.

13. The method according to claim 3, wherein the mouth portion is formed by etching a trench into the bottom surface of the substrate, passivating the internal walls of the trench with an etch mask layer, and removing the material of the substrate that is surrounded by the trench.

14. The method according to claim 4, wherein the mouth portion is formed by etching a trench into the bottom surface of the substrate, passivating the internal walls of the trench with an etch mask layer, and removing the material of the substrate that is surrounded by the trench.

15. The method according to claim 5, wherein the mouth portion is formed by etching a trench into the bottom surface of the substrate, passivating the internal walls of the trench with an etch mask layer, and removing the material of the substrate that is surrounded by the trench.

16. The method according to claim 2, the method comprising (a) forming a trench in a surface of the substrate, which trench is positioned at a desired position of a wall of the mouth portion;

(b) filling the trench with an etch resistant material, thereby passivating the internal walls of the trench with an etch mask layer;

(c) applying an etch resistant mask layer on the surface of the substrate;

(d) providing a mask opening in the etch resistant mask layer such that an edge of the mask opening is positioned on the etch resistant material arranged in the trench;

(e) performing a dry etch of the substrate through the mask opening such that the resulting mouth portion is positioned by the etch resistant material arranged in the trench.

17. The method according to claim 3, the method comprising (a) forming a trench in a surface of the substrate, which trench is positioned at a desired position of a wall of the mouth portion;

(b) filling the trench with an etch resistant material, thereby passivating the internal walls of the trench with an etch mask layer;

(c) applying an etch resistant mask layer on the surface of the substrate;

(d) providing a mask opening in the etch resistant mask layer such that an edge of the mask opening is positioned on the etch resistant material arranged in the trench;

(e) performing a dry etch of the substrate through the mask opening such that the resulting mouth portion is positioned by the etch resistant material arranged in the trench.

18. The method according to claim 4, the method comprising (a) forming a trench in a surface of the substrate, which trench is positioned at a desired position of a wall of the mouth portion;

(b) filling the trench with an etch resistant material, thereby passivating the internal walls of the trench with an etch mask layer;

(c) applying an etch resistant mask layer on the surface of the substrate;

(d) providing a mask opening in the etch resistant mask layer such that an edge of the mask opening is positioned on the etch resistant material arranged in the trench;

(e) performing a dry etch of the substrate through the mask opening such that the resulting mouth portion is positioned by the etch resistant material arranged in the trench.

19. The method according to claim 5, the method comprising (a) forming a trench in a surface of the substrate, which trench is positioned at a desired position of a wall of the mouth portion;

(b) filling the trench with an etch resistant material, thereby passivating the internal walls of the trench with an etch mask layer;

(c) applying an etch resistant mask layer on the surface of the substrate;

(d) providing a mask opening in the etch resistant mask layer such that an edge of the mask opening is positioned on the etch resistant material arranged in the trench;

(e) performing a dry etch of the substrate through the mask opening such that the resulting mouth portion is positioned by the etch resistant material arranged in the trench.

* * * * *